United States Patent [19]

Jarvis

[11] 4,239,213

[45] Dec. 16, 1980

[54] STEADINESS TESTING GAME

[76] Inventor: Arthur B. Jarvis, 46 Alexander Ave., San Rafael, Calif. 94901

[21] Appl. No.: 35,831

[22] Filed: May 4, 1979

[51] Int. Cl.[3] ..... A63F 9/00

[52] U.S. Cl. ..... 273/1 E

[58] Field of Search ..... 273/1 E; 35/22 R

[56] References Cited

U.S. PATENT DOCUMENTS

| | | | |
|---|---|---|---|
| 2,508,146 | 5/1950 | D'Elia | 273/1 E |
| 3,208,747 | 9/1965 | Kavakos | 273/1 E |
| 3,942,629 | 3/1976 | Ueno et al. | 273/1 E X |

FOREIGN PATENT DOCUMENTS

| | | | |
|---|---|---|---|
| 652631 | 12/1964 | Belgium | 273/1 E |
| 649908 | 10/1962 | Canada | 273/1 E |
| 966229 | 3/1950 | France | 273/1 E |
| 395174 | 7/1933 | United Kingdom | 273/1 E |
| 1180737 | 2/1970 | United Kingdom | 273/1 E |

OTHER PUBLICATIONS

"Beat the Buzz" by Kenner, Playthings Magazine, 8-1959.

Cadaco 1970 Catalog, #296 "Shaky Jake", 3-1970.

*Primary Examiner*—Paul E. Shapiro

*Attorney, Agent, or Firm*—Owen, Wickersham & Erickson

[57] ABSTRACT

A steadiness testing game has a convoluted conductive track along which a user moves a conductive ring, attempting to minimize contact of the ring with the track. Each instance of contact causes a signal such as a buzzer to be activated, and a counter may be provided to total the instances of contact to provide a score for the user. A timer may also be included, displaying the elapsed time taken by the user. In one embodiment the convoluted track is mounted so as to swivel to different angles to present different challenges to the user.

2 Claims, 6 Drawing Figures

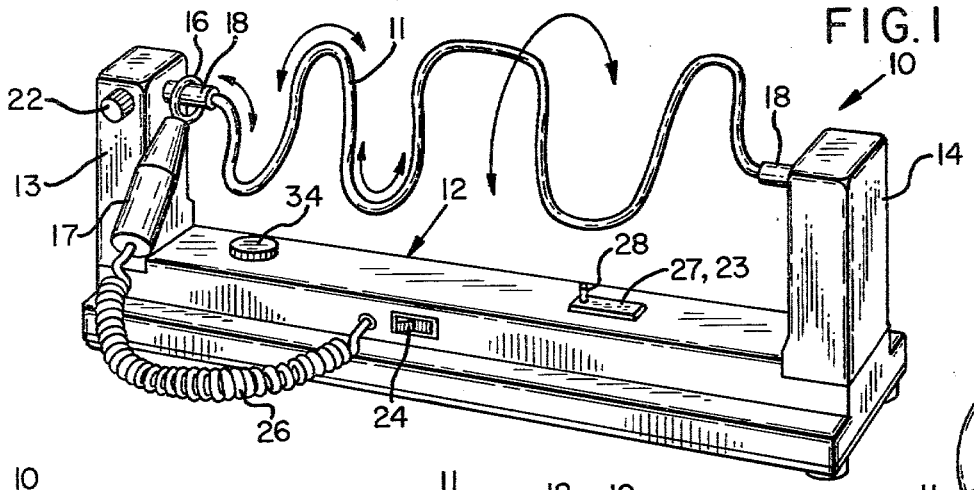
FIG. 1
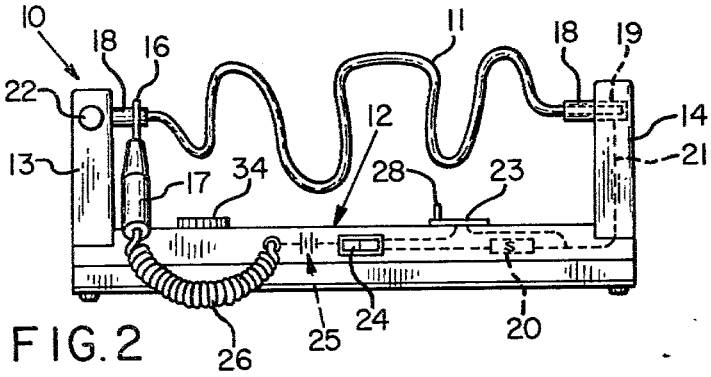
FIG. 2
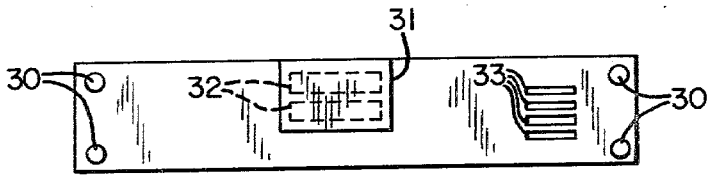
FIG. 3
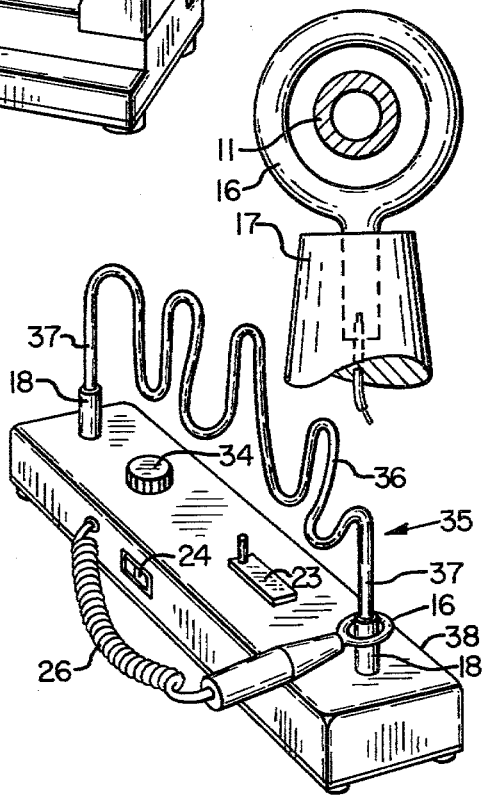
FIG. 4
FIG. 5
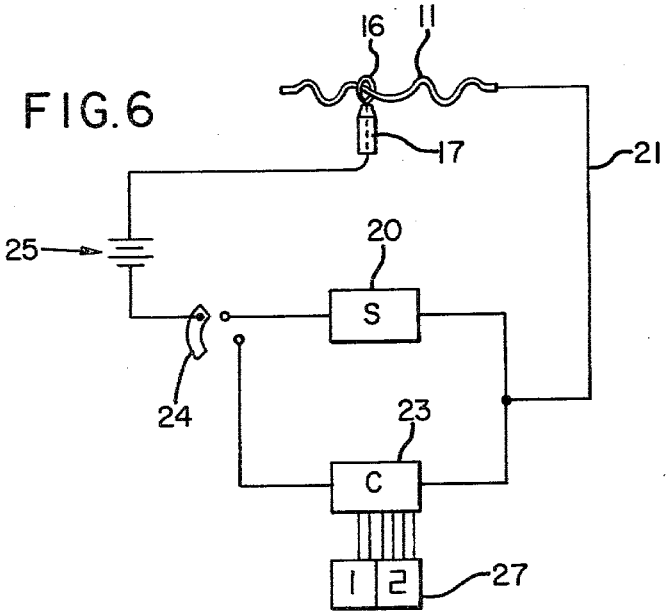
FIG. 6

STEADINESS TESTING GAME

BACKGROUND OF THE INVENTION

The invention relates to a game or human aptitude testing apparatus, and more particularly to a device by which a user or player tests his steadiness in attempting to keep a hand-held object along a preselected path with relatively close tolerances.

Many types of games, puzzles and devices designed to test the steadiness of the hand of the player or user have been suggested. While some of these games have been popular and effective as testing the player's steadiness, none has exhibited the combination of the desirable features of simplicity, versatility, testing ability and entertainment as does the game apparatus of the present invention described below.

SUMMARY OF THE INVENTION

The invention is a parlor type game and manual steadiness testing apparatus which is very intriguing in nature and yet simple in construction and in manufacture. The device consists of a base supporting a convoluted or meandering track of electrically conductive material such as brass, and a handle with a conductive metal ring positioned circumadjacent the track, such that the user holds the handle and moves the ring over the track, attempting to minimize or eliminate contact of the two conductive members. Each instance of contact activates a signal which may be a buzzer or alarm, or a visual indicator. Also, a counter is preferably provided in the circuit with the conductive members, for registering and totalling each instance of contact to provide a score for the player or user.

In a preferred embodiment the convoluted conductive track is mounted pivotally on a generally horizontal axis between two upright members of the base, so that the orientation of the track can be varied to provide different types of challenge. A set screw may be provided in one of the uprights to lock the conductive track in a selected position. The track preferably has short insulated sleeves over both ends, near the upright members of the base, for resting the conductive ring and handle without activating the signal. The handle and attached ring are preferably connected to the base and the remainder of the circuitry by a coiled, expandable wire as on a telephone or microphone.

The pivotal conductive track must be connected to the circuit inside the base, and this is accomplished through the use of conductive metal sleeves set in the base uprights, within which the ends of the track are snugly fit. The conductive sleeves are wired into the circuit, and when the track is pivoted, its ends rotate within the sleeve while the sleeve remains stationary.

Accordingly, in one embodiment the steadiness testing game of the invention comprises a base; a convoluted electrically conductive track member having ends connected into the base; an electrically conductive ring positioned circumjacent the electrically conductive track member, having a clearance over the track member from one end to the other; a handle attached to the conductive ring, permitting manipulation of the ring by a user; a signal device connected to a power source; and an electrical circuit connecting the conductive track member, the conductive ring, and the signal device and power source such that contact of the ring with the track member closes the circuit and activates the power source; whereby the steadiness of the user is tested as he attempts to move the ring over the track member avoiding contact of the two conductive members, which will cause the signal to be activated.

It is therefore among the objects of the invention to provide a novel and intriguing steadiness testing game which is relatively simple in construction yet challenging and revealing to the player or user. These and other objects, advantages and features will be apparent from the following description of the preferred embodiments, taken in conjunction with the accompanying drawings.

DESCRIPTION OF THE DRAWINGS

FIG. 1 is a perspective view showing a steadiness testing game according to the invention.

FIG. 2 is an elevational view of the game apparatus.

FIG. 3 is a bottom plan view of the apparatus.

FIG. 4 is a view showing the relationship between a conductive ring and conductive track of the game apparatus.

FIG. 5 is a perspective view showing a modified form of the invention.

FIG. 6 is a schematic diagram indicating the circuitry employed in the game apparatus of the invention.

DESCRIPTION OF THE PREFERRED EMBODIMENTS

In the drawings, FIG. 1 shows a preferred embodiment of a steadiness testing game apparatus 10 according to the invention, comprising a convoluted or meandering conductive track 11 mounted in a base 12 including a pair of uprights 13 and 14 at its ends, and a conductive ring 16 attached to a handle 17 which is held in the hand of the user, who attempts to guide it over the track 11 avoiding contact of the ring 16 with the track 11. As FIGS. 1 and 4 illustrate, the ring 16 is sized to have a preselected clearance over the track 11, and this clearance is selected in accordance with the desired degree of difficulty of the game. For example, the inside diameter of the ring may be about one-half inch, with the outside diameter of the conductive track 11 at about one-fourth inch. The track 11 may be a tubular section, or it may be solid if desired. The ring and track may be made of any conductive material, but brass is preferably used for its appearance and noncorrosive nature, especially if the base 12 is made of finished wood.

At each end of the conductive track 11 there is preferably provided some sort of insulator, such as plastic sleeves 18 as illustrated in the drawing. This enables the handle 17 and conductive ring 16 to be rested at either end without making contact between the two conductive members.

The track 11 is preferably connected into the uprights 13 and 14 of the base in a swiveling or pivoted connection, permitting rotational adjustment of the track 11 about a generally horizontally axis. Such connections may simply comprise, as partially illustrated in FIG. 2, a conductive metal sleeve 19 set fixedly into the upright member, with the end of the track 11 fitted closely into the sleeve, permitting rotation of the track within the sleeve. The conductive track 11 forms a part of an electric circuit represented schematically in FIG. 2 by a dashed line 21 indicating wire, and this wire may simply be connected to the conductive metal sleeve 19, so that regardless of rotational position the conductive track 11 is securely connected into the circuit. Although such a rotational electric coupling may be provided at both ends of the track, also serving as a bearing, at one end (at the upright 13 in FIG. 2) the conductive track may simply be fitted into a bore of the upright, and a set screw 22 may be included for locking the track in any desired rotational position.

The electric circuit is also illustrated in FIG. 6, in somewhat greater detail. It is a simple open circuit including the conductive track 11 connected by the wire 21 to a signal device 20 and also preferably to a counter 23 in parallel as shown, then through an off-on switch 24 to a power source 25 which may be batteries or wall current. The power source 25 in turn is connected through a coiled, retractable type wire 26 (FIG. 2) and through the handle 17 to the conductive ring 16. As indicated in FIG. 6, the counter 23 is an IC counter and includes a digital display unit 27 which indicates the number of instances of contact that are made between the ring 16 and the track 11 as a player moves the ring through its course. The counter 23, display 27 and their internal circuitry are well known and conventional. When a player has moved the ring over the course once or the number of times agreed upon, the counter display 27 shows the total number of instances of contact. A reset button 28 (FIG. 2) may then be pushed to set the counter back at zero.

As also illustrated in the schematic diagram of FIG. 6, the switch 24 is preferably of the three-position type, having an off position as shown, as well as a position in which only the signal device 20 is connected and a further position (maximum clockwise for the rotary switch shown) wherein both the signal device and the counter 23 are connected.

The signalling device 20 preferably comprises a buzzer, bell or other type audible alarm, but may alternatively comprise a visible signal if desired.

FIG. 3 shows the bottom of the steadiness testing apparatus 10, revealing pads or feet 30 at each corner and a cover plate 31 which may be removed for access to and replacement of batteries 32 representing the power source 25, if batteries are used. Openings 33 may be provided for the audible signal 20.

The apparatus 10 also preferably includes a clock or timing device 34 as illustrated in the figures. This may be a stop-watch type timing device simply to keep track of the time taken by the user or player in following the track through its course the selected number of times. The timer 34 is not electrically connected to the remaining circuitry, but preferably functions independently, although an appropriate timer may be wired into the circuit if desired.

FIG. 5 shows a modified form of a steadiness testing game of the invention, wherein a conductive track 36 has ends 37 that are fixedly secured into the base 38, which simply comprises a generally rectangular platform as shown. Thus, adjustment of the orientation of the track 36 is not permitted with this embodiment, but otherwise the features are the same. The apparatus 35 includes the conductive ring 16 connected to the handle 17, the insulative plastic sleeves 18 at the ends of the track 37, the counter 23, clock 34, etc. This embodiment is simple in construction yet still provides a challenging test of the user's skill and steadiness.

The above described preferred embodiments provide a steadiness testing device or game which is simple in construction and in use, but yet versatile and challenging to the user. Various other embodiments and alterations to these preferred embodiments will be apparent to those skilled in the art and may be made without departing from the spirit and scope of the following claims.

I claim:

1. A steadiness testing game, comprising;

a base;

a convoluted electrically conductive track member having ends connected into the base, with the ends extending in opposite directions along a generally horizontal axis;

pivotal mounting means providing for rotary adjustment of the position of the conductive track on the base along said horizontal axis;

an electrically conductive ring positioned circumjacent the electrically conductive track member, having a clearance over the track member and adapted to be moved over the track member from one end to the other;

a handle attached to the conductive ring, permitting manipulation of the ring by a user;

a signal device connected to a power source; and an electrical circuit connecting the conductive track member, the conductive ring, and the signal device and power source such that contact of the ring with the track member closes the circuit and activates the power source;

whereby the steadiness of the user is tested as he attempts to move the ring over the track member avoiding contact of the two conductive members, which will cause the signal device to be activated.

2. A steadiness testing game, comprising:

a base;

a convoluted electrically conductive track member having ends connected into the base;

pivotal mounting means providing for rotary adjustment of the position of the conductive track on the base along a generally horizontal axis and comprising, at one end of the conductive track, a conductive sleeve mounted in the base, with the conductive track having a generally cylindrical end closely fitted in the sleeve;

an electrically conductive ring positioned circumjacent the electrically conductive track member, have a clearance over the track member and adapted to be moved over the track member from one end to the other;

a handle attached to the conductive ring, permitting manipulation of the ring by a user;

a signal device connected to a power source; and an electrical circuit connecting the conductive sleeve and track member, the conductive ring, and the signal device and power source such that contact of the ring with the track member closes the circuit and activates the power source;

whereby the steadiness of the user is tested as he attempts to move the ring over the track member avoiding contact of the two conductive members, which will cause the signal device to be activated.

* * * * *